US006409429B1

(12) United States Patent
Belloni

(10) Patent No.: US 6,409,429 B1
(45) Date of Patent: Jun. 25, 2002

(54) BACKPACK FOR UNDERWATER BREATHING GAS TANKS

(75) Inventor: Alberto Belloni, Recco (IT)

(73) Assignee: HTM Sport S.P.A. (IT)

( * ) Notice: Subject to any disclaimer, the term of this patent is extended or adjusted under 35 U.S.C. 154(b) by 0 days.

(21) Appl. No.: 09/624,164

(22) Filed: Jul. 24, 2000

(30) Foreign Application Priority Data

Jul. 28, 1999 (IT) ..... GE99U0026

(51) Int. Cl.[7] ..... B63C 11/22; A45F 3/08

(52) U.S. Cl. ..... 405/186; 405/185; 441/92; 224/907

(58) Field of Search ..... 405/185, 186, 405/187; 441/88, 90, 92, 106, 114; 224/246, 907; 190/115, 18 A

(56) References Cited

U.S. PATENT DOCUMENTS

| | | | | | |
|---|---|---|---|---|---|
| 3,805,929 | A | * | 4/1974 | Kuwayama | 190/18 A |
| 3,957,183 | A | * | 5/1976 | Gadberry | 224/628 |
| 4,299,313 | A | * | 11/1981 | Null | 190/18 A |
| 4,310,110 | A | * | 1/1982 | Dexter | 224/246 |
| 4,345,789 | A | * | 8/1982 | Garnett | 294/31.2 |
| 4,358,006 | A | * | 11/1982 | Castelli | 190/18 A |
| 4,455,718 | A | * | 6/1984 | Finnern | 405/186 |
| 4,463,978 | A | | 8/1984 | Mountain et al. | |
| 4,561,526 | A | * | 12/1985 | Winter et al. | 190/115 |
| 4,690,314 | A | * | 9/1987 | Faulconer et al. | 441/90 X |
| 4,752,263 | A | | 6/1988 | Pritchard | |
| 5,046,894 | A | | 9/1991 | Bergstrom | |
| 5,494,377 | A | * | 2/1996 | Garofalo | 405/186 |
| 5,567,084 | A | | 10/1996 | Oliver | |

FOREIGN PATENT DOCUMENTS

| | | | |
|---|---|---|---|
| DE | 34 17 823 | | 3/1985 |
| DE | 44 36 726 | | 4/1995 |
| EP | 1072506 | * | 1/2001 |
| FR | 27 06 434 | | 2/1995 |
| GB | 2247653 | * | 3/1992 |

* cited by examiner

*Primary Examiner*—Heather Shackelford
*Assistant Examiner*—Jong-Suk Lee
(74) *Attorney, Agent, or Firm*—Larson & Taylor, PLC

(57) ABSTRACT

A backpack for underwater breathing gas tanks including a substantially flattened body, at one side of which is connected at least one tank, the other side designed to be connected with the diver's back, and provided with a handle for easy lifting. The handle is positioned in a cavity formed in the body of the backpack and may be moved from a raised, active position to an inserted, inactive position.

5 Claims, 1 Drawing Sheet

BACKPACK FOR UNDERWATER BREATHING GAS TANKS

BACKGROUND AND SUMMARY OF THE INVENTION

The present invention refers to a backpack for underwater breathing gas tanks.

The backpacks for underwater breathing gas tanks are generally formed by a body, for the most part monolithic and substantially flattened, one side of which is designed for the coupling with one or more tanks, while the other is provided with the means used to fasten said backpack to the diver back. Normally these backpacks are provided, for their transport once connected to the tank/s, with a carrying means generally connected to the end of the backpack body facing the end of the tank with the supplying means.

The so positioned carrying means can have certain disadvantages, such as the carrying uneasiness, even if just for short distances, due to the substantial height of the backpack and tanks assembly. Also the distribution and the disposition of the load contribute to make the previously described setting awkward.

The aim of the present invention is then to provide for a backpack for underwater breathing gas tanks which can be carried in an easier way, without introducing, for this reason, structural changes which damage its functionality during a dive.

An object of the present invention is then to provide a backpack for underwater breathing gas tanks including a substantially flattened body, at one side of which is connected at least one tank, the other side being designed for connection with the diver's back, and provided with carrying means, characterized in that it is positioned in a cavity molded, in a substantially central position, in the side designed for the connection with the diver's back.

BRIEF DESCRIPTION OF THE DRAWINGS

Further advantages and features of the device according to the present invention will be more clearly understood by referring to the description below and the accompanying drawings in which.

DESCRIPTION OF THE PREFERRED EMBODIMENT OF THE INVENTION

Figure 1:
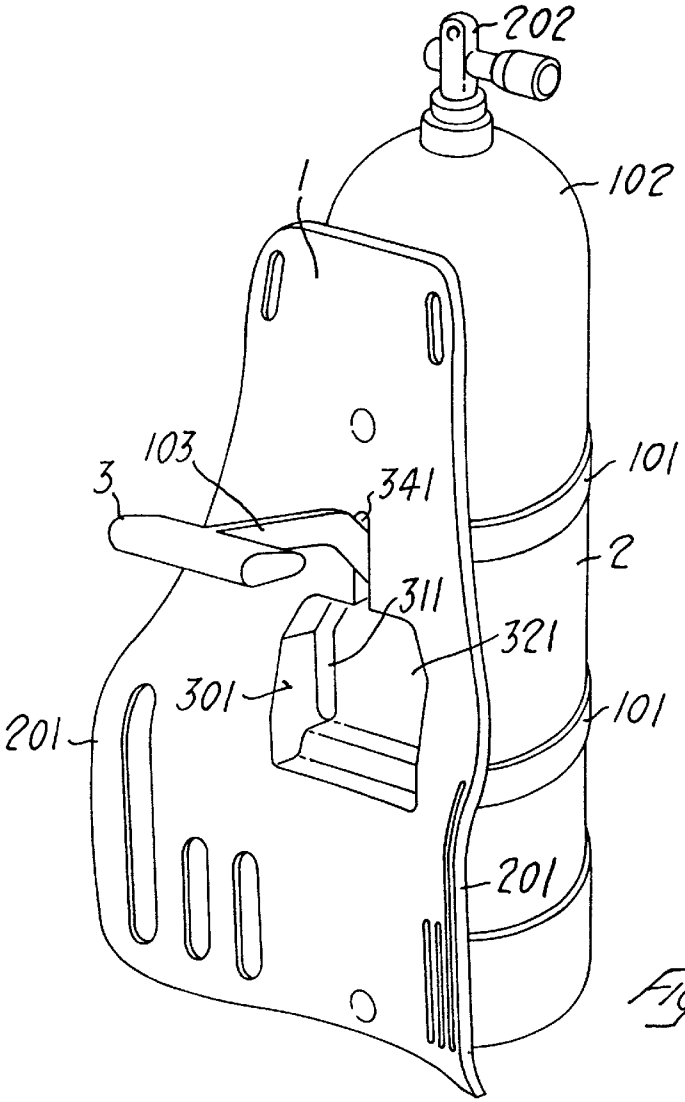
FIG. 1 is a perspective view of the backpack according to the present invention.

In FIG. 1 one embodiment of the backpack according to the present invention is shown. According to this embodiment, by reference numeral 1 the body of said backpack is shown. Said body 1 is substantially flattened and has two molded wings 201 turned to the backpack side designed for the connection with the diver. The backpack is connected, through the belts 101, to the tank 2 which is provided at its end 102 with the compressed air valve means 202 for controlling the amount of air delivered by the tank 2. In a substantially central position of the backpack, on the side facing the diver, the cavity 301 is provided, on its sidewalls near an end wall 321, slits 311. In the channel 341 formed at one end of the cavity 301 the stem 103 of the handle 3 is housed.

Figure 2:
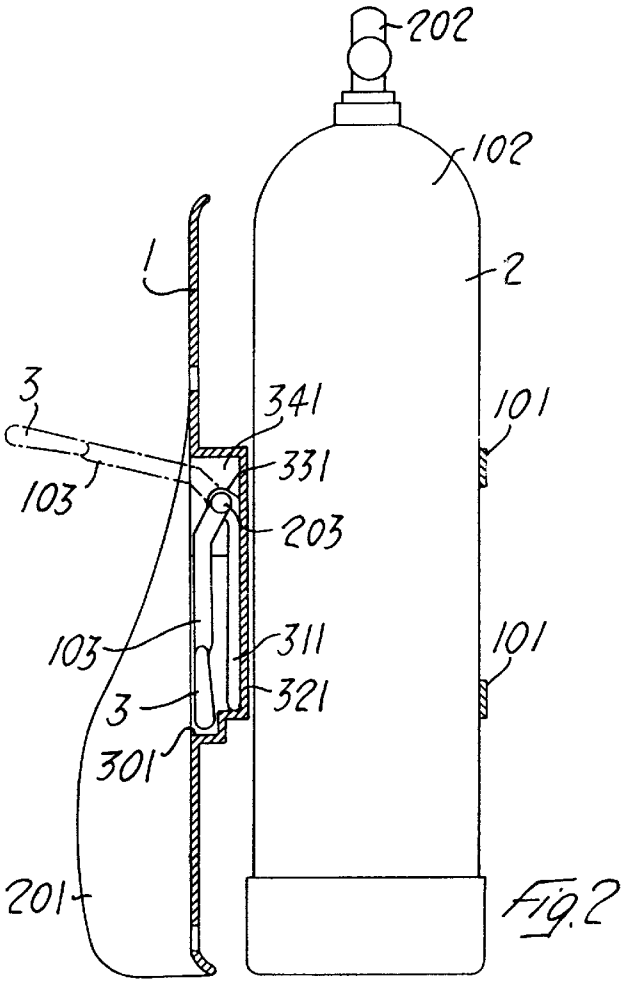
FIG. 2 is a longitudinal sectional view of the backpack of FIG. 1.

In FIG. 2 the backpack of the invention is shown in a longitudinal section. The handle 3 and its stem 103 are shown in the inserted position in the cavity 301. The stem 103 is provided, at the end opposite to the one with the handle 3, with a pin 203, which may be inserted into recesses 331 formed in slits 311 inside the channel 341. In FIG. 2 the handle 3 is shown by dash and dot line, also in the raised position like that of FIG. 1.

The operation of the backpack according to the invention will be evident. The handle 3 is connected to the backpack body 1 through the pin 203 projecting from the stem 103 of said handle 3 into the recess 331 of the slit molded in the wall of the cavity 301. When the handle 3 is in the raised, active position shown in FIG. 1, the user carries the tank assembly with much more ease and handiness. When said handle 3 is not used to carry the backpack, it is inserted back into the cavity 301 formed in the backpack body 1.

Advantageously, the handle is inserted with the stem pin 203 inserted in the recess 331 of the slit 311; in this way the handle 3 is led to a raised, active position, indicated with dash and dot lines in FIG. 2, or an inserted, inactive position, by simply rotating it around said pin. The slit 311 is made in such a way that the pin 203 is inserted into the same and then led into the recess 331; the end of the cavity resiliently urges the pin 203 towards said recess 331, thus assisting its correct positioning.

What is claimed is:

1. A backpack for underwater breathing gas tanks comprising:

a substantially flattened body;

means at one side of said body for connecting at least one tank to said body;

means at the other side of said body for connecting with a diver's back;

said body having a cavity provided on the side designed for connecting with the diver's body; and carrying means for lifting the backpack, attached to said body, wherein said carrying means is capable of being rotated to a raised, active position such that the carrying means is outside said cavity and an inserted, inactive position such that the carrying means is located completely inside said cavity.

2. A backpack according to claim 1, wherein said cavity is centrally located on said body.

3. A backpack according to claim 1, wherein said carrying means further comprises a handle provided with a stem.

4. A backpack according to claim 3, wherein said stem further comprises at least one pin which can be inserted into recesses provided in said cavity.

5. A backpack according to claim 4, wherein said cavity includes side walls and an end wall, a slit formed in each of said side walls, a channel formed on one side of said cavity, wherein said recesses for said at least one pin are formed along said slits in communication with said channel.

* * * * *